US007437819B1

(12) United States Patent
Escobedo

(10) Patent No.: US 7,437,819 B1
(45) Date of Patent: Oct. 21, 2008

(54) METHOD FOR MAKING UNDER WATER CONNECTOR

(75) Inventor: Rudolph B. Escobedo, Middletown, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 107 days.

(21) Appl. No.: 11/602,433

(22) Filed: Oct. 19, 2006

(51) Int. Cl.
*H01R 43/16* (2006.01)

(52) U.S. Cl. ..... 29/874; 29/883; 29/885; 29/876; 29/858; 264/272.2

(58) Field of Classification Search ..... 29/855–858, 29/866–867, 874–885, 870; 439/271, 278, 439/417, 393, 606, 686, 693–695, 281, 283; 264/255, 273–275, 272.2, 272.11, 272.1; 428/469, 472, 701, 702
See application file for complete search history.

(56) References Cited

U.S. PATENT DOCUMENTS 5,120,268 A * 6/1992 Gerrans ..... 439/736
5,387,119 A * 2/1995 Wood ..... 439/281
5,641,307 A * 6/1997 Gerrans ..... 439/606
5,930,892 A * 8/1999 Kato et al. ..... 29/861
5,984,705 A * 11/1999 Miyazaki et al. ..... 439/304
RE37,340 E * 8/2001 King, Jr. ..... 264/272.11
7,004,789 B2 * 2/2006 Kameyama et al. ..... 439/587
7,124,560 B2 * 10/2006 Brieden ..... 53/587

* cited by examiner

*Primary Examiner*—Minh Trinh
(74) *Attorney, Agent, or Firm*—James M. Kasischke; Michael P. Stanley; Jean-Paul A. Nasser

(57) ABSTRACT

A method for sealing an electrical connector having a transition end and a cable. A protective coating is applied to the transition end of the connector. The connector, transition end and cable are positioned within halves of a mold. An annular resilient seal is positioned about the transition end within the mold. When the mold is filed with castable material the annular resilient seal compresses against the connector, preventing leakage of the castable material along the connector. The mold can then be separated leaving a waterproof boot formed on the transition end of the connector. The invention also provides a mold and sealing means for this process.

5 Claims, 3 Drawing Sheets

METHOD FOR MAKING UNDER WATER CONNECTOR

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention relates generally to underwater connectors. More particularly, this invention relates to an improvement for underwater connectors having a flexible boot bonded onto a non-conductive electrical connector that reliably seals the interface between the boot and connector to assure long-term reliable operation.

(2) Description of the Prior Art

Referring to FIG. 1, prior art multi-pin electrical connectors 50 have connector housings 51 that are typically made from a conductive metal such as aluminum or stainless steel. Multi-pin electrical connector 50 can connect to an electrical cable 80 having a number of electrical conductors 52 (only one of which is shown in FIG. 1) in an end portion 55 having a collar-like threaded nut 56 or other securing device to engage a correspondingly shaped threaded section 61 in electrical fitting 60. Each electrical conductor 52 is secured to pin 53 that is sized to slide into a mating sleeve 62 in fitting 60 to complete an electrical interconnection when nut 56 is tightened onto section 61. At least one O-ring 57 on end portion 55 creates a seal between connector 50 and an internal bore 63 in fitting 60.

In many uses an electrically nonconductive and corrosion resistant protective coating 70 measuring about 0.0010±0.005 inches thick is applied to housing 51 of connector 50 by spraying-on coating 70. A protective coating can be applied on fitting 60 as well.

However, protective coating 70 on housing 51 can be formed with irregular surfaces 71 as a consequence of imperfections of the spraying application technique. Irregular surfaces 71 can also be created on housing 51 as a consequence imperfections in the manufacturing process of connector 50.

These irregular surfaces 71 in coating 70 on housing 51 can be troublesome in connectors 50 particularly where housing 51 has an annular-shaped transition end 54 extending outside of an electrical cable 80. Electrical cable 80 can extend from connector 50 through water 5 to connect transducers or other sensors (not shown) to fitting 60 that can act as an electrical hull penetrator outboard of the pressurized hull of a Navy submarine, for example. A waterproof boot 90 is molded about transition end 54 of connector housing 51 and electrical cable 80.

Waterproof boot 90 is the mechanical transition to the outer jacket 81 of electrical cable 80 and is made from a sealing-casting material that cures into boot 90. Boot has a flexible waterproof form that resists sharp bending of cable 80 where it enters and is secured to connector 50 by an internal lock nut (not shown). Casting material is typically a synthetic rubber such as silicone, Neoprene™ or the like having the properties of being waterproof and tough with sufficient flexibility, etc. for reliable operation in the demanding marine environment. Boot 90 bonds to an outer surface 54A and an inner surface 54B of transition end 54. Boot 90 contacts outer surface 54A at an annular interface 92 an annular tapered part 93 provides a transition.

Referring now to FIG. 2, boot 90 is molded by positioning two halves of a mold 95 to define a casting cavity 96 to contain transition end 54 of connector housing 51 and cable 80. Casting chamber 96 of mold 95 is coated with a suitable release agent (not shown) to allow removal of boot 90 after it has cured. Mold 95 has a cable end 95A positionable about outer jacket 81 of electrical cable 80 and a connector end 95B positionable about part of connector 50. Only the bottom half of rigid mold 95 is shown, it being understood that the mirror-image top half of mold 95 is placed over and tightly secured to bottom half to define casting cavity 96 for waterproof boot 90. Mold 95 is then filled with a liquid form of casting material via a open-ended filling cavity 97 at cable end 95A that is in communication with casting cavity 96. Casting material sets or cures into waterproof boot 90. (See FIG. 1.)

Casting cavity 96 is shaped to define waterproof boot 90 and forms a boot termination shoulder 96A for shoulder 93 of boot 90 toward connector end 95B of mold 95. An O-ring groove 95C is adjacent boot termination shoulder 96A to receive an O-ring 95D, and a connector shoulder cavity 95E is by inward flange 95F at connector end 95B of mold 95.

During the casting procedure of waterproof boot 90 in mold 95, filling cavity 97 faces upward and connector 50 has a shoulder 72 against inward flange 95F in connector shoulder cavity 95E and has transition end 54 fitted into O-ring 95D to hold and prevent leakage of liquid casting material. The other half (not shown) of mold 95 is fitted so that O-ring 95D is positioned to annularly coextend in the other half of termination shoulder O-ring groove 95C. Mold 95 is then filled with liquid sealing-casting material.

Casting material of boot 90 bonds or adheres to outer jacket 81 of electrical cable 80 along the length of cable 80 covered by boot 90 in a watertight sealed relationship and this bonding prevents any leaking of ambient water 5 along the juncture between outer jacket 81 and boot 90. However, water 5 can and does leak into connector 50 due to imperfections 71 or unevenness of protective coating 70 on transition end 54 of housing 51.

Leakage of water 5 compromises reliable operation of connector 50 due to irregularities 71 in protective coating 70 on transition end 54 of housing 51. These irregularities 71 are exposed to ambient water 5 at an annular interface 92 on transition end 54 near the center of housing 51 at the end of waterproof boot 90. Leakage of water 5 at annular interface 92 is likely to occur because of imperfections of application of coating 70. Water 5 which has leaked through annular interface 92 seeps under annular tapered part 93 of boot 90 and to the left along annular interface 54 between boot 90 and along the top 54A of transition end 54. Next, leaked water 5 goes back to the right toward fitting 60 between boot 90 and along the bottom 54B of transition end 54 and onward into connector 50 to disrupt reliable operation of its other internal constituents.

Thus, in accordance with this inventive concept, a need has been recognized in the state of the art for a cost-effective improvement for underwater connectors that prevents water leakages attributable to irregularities in protective coatings.

SUMMARY OF THE INVENTION

The first object of the invention is to provide an underwater connector having greater reliability.

Another object of the invention is to provide an underwater connector preventing water leakages attributable to irregularities in the surfaces of housings and protective coatings thereon.

Another object is to provide a method of making an underwater connector preventing water leakages attributable to irregularities in the surfaces of housings and protective coatings thereon.

These and other objects of the invention will become more readily apparent from the ensuing specification when taken in conjunction with the appended claims.

Accordingly, the present invention is A method for sealing an electrical connector having a transition end and a cable. A protective coating is applied to the transition end of the connector. The connector, transition end and cable are positioned within halves of a mold. An annular resilient seal is positioned about the transition end within the mold. When the mold is filed with castable material the annular resilient seal compresses against the connector, preventing leakage of the castable material along the connector. The mold can then be separated leaving a waterproof boot formed on the transition end of the connector. The invention also provides a mold and sealing means for this process.

BRIEF DESCRIPTION OF THE DRAWINGS

A more complete understanding of the invention and many of the attendant advantages thereto will be readily appreciated as it becomes better understood by reference to the following detailed description when considered in conjunction with the accompanying drawings wherein like reference numerals refer to like parts and wherein.

DESCRIPTION OF THE PREFERRED EMBODIMENT

Figure 1:
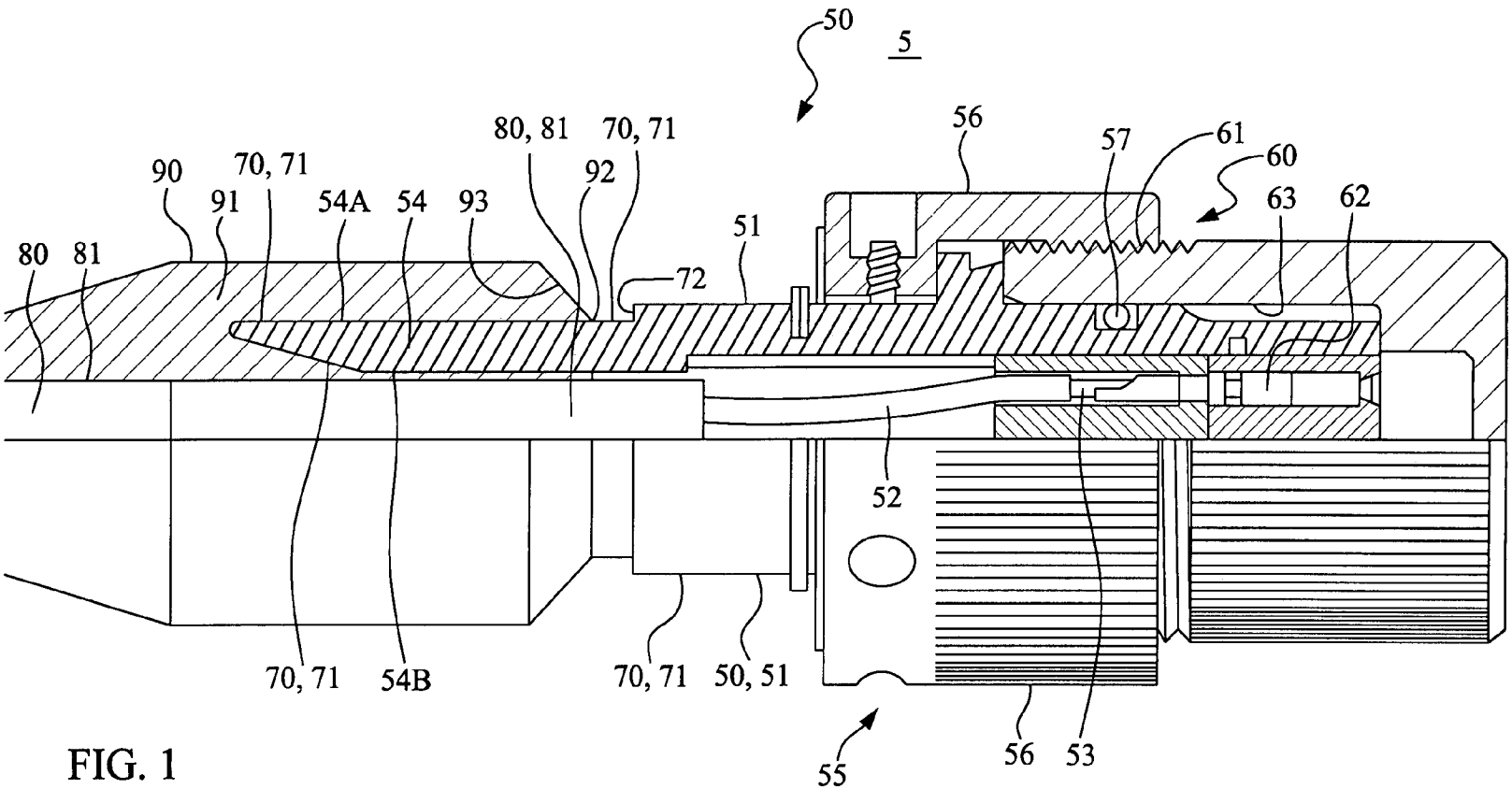
FIG. 1 PRIOR ART
FIG. 1 is a schematic showing partially in cross section of a typical prior art underwater connector having a waterproof boot.
Figure 2:
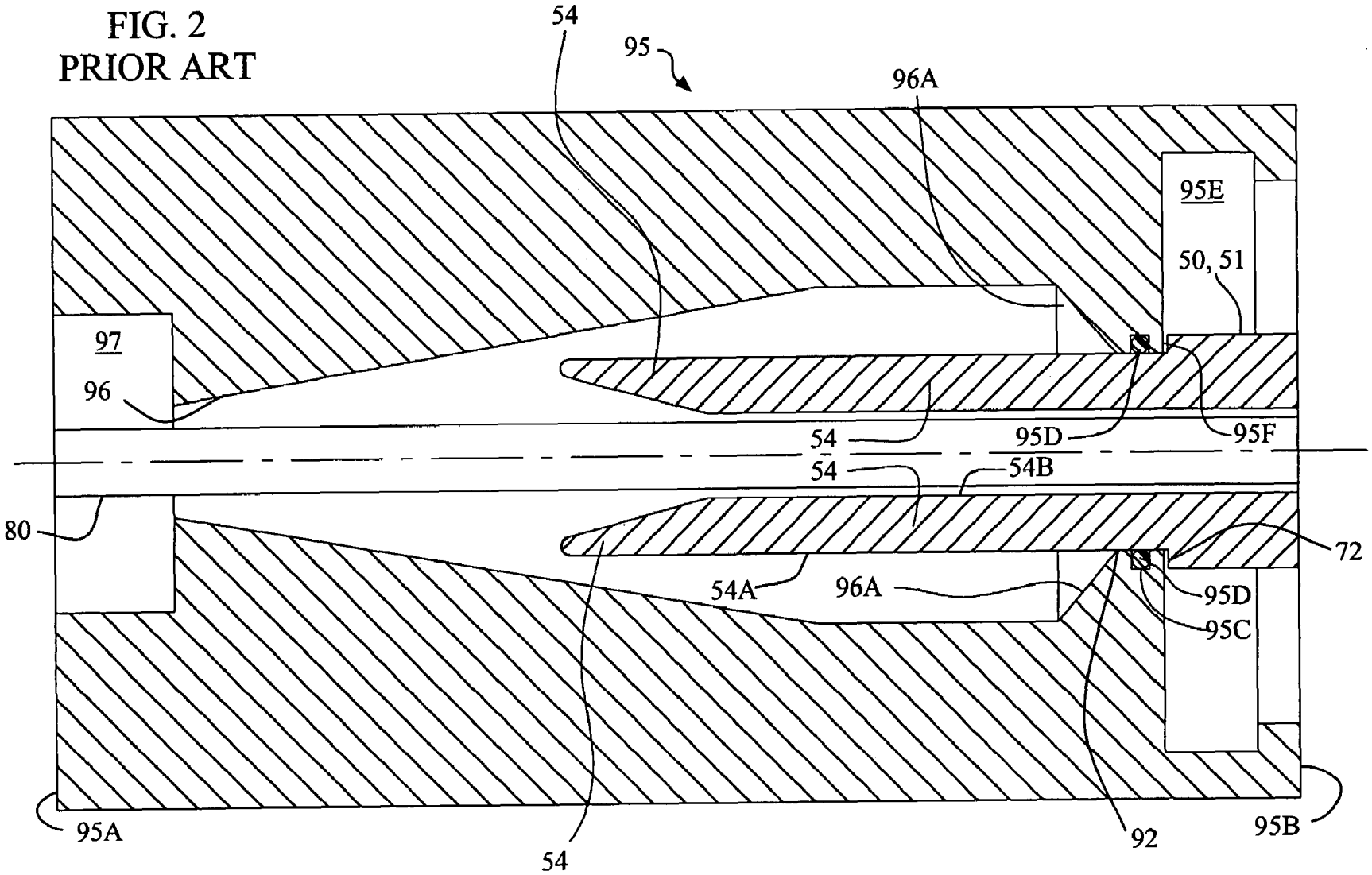
FIG. 2 PRIOR ART
FIG. 2 is a schematic showing of one half of a casting mold defining a casting cavity for a waterproof boot that is molded on part of the electrical cable and transition end of the prior-art underwater connector.
Figure 3:
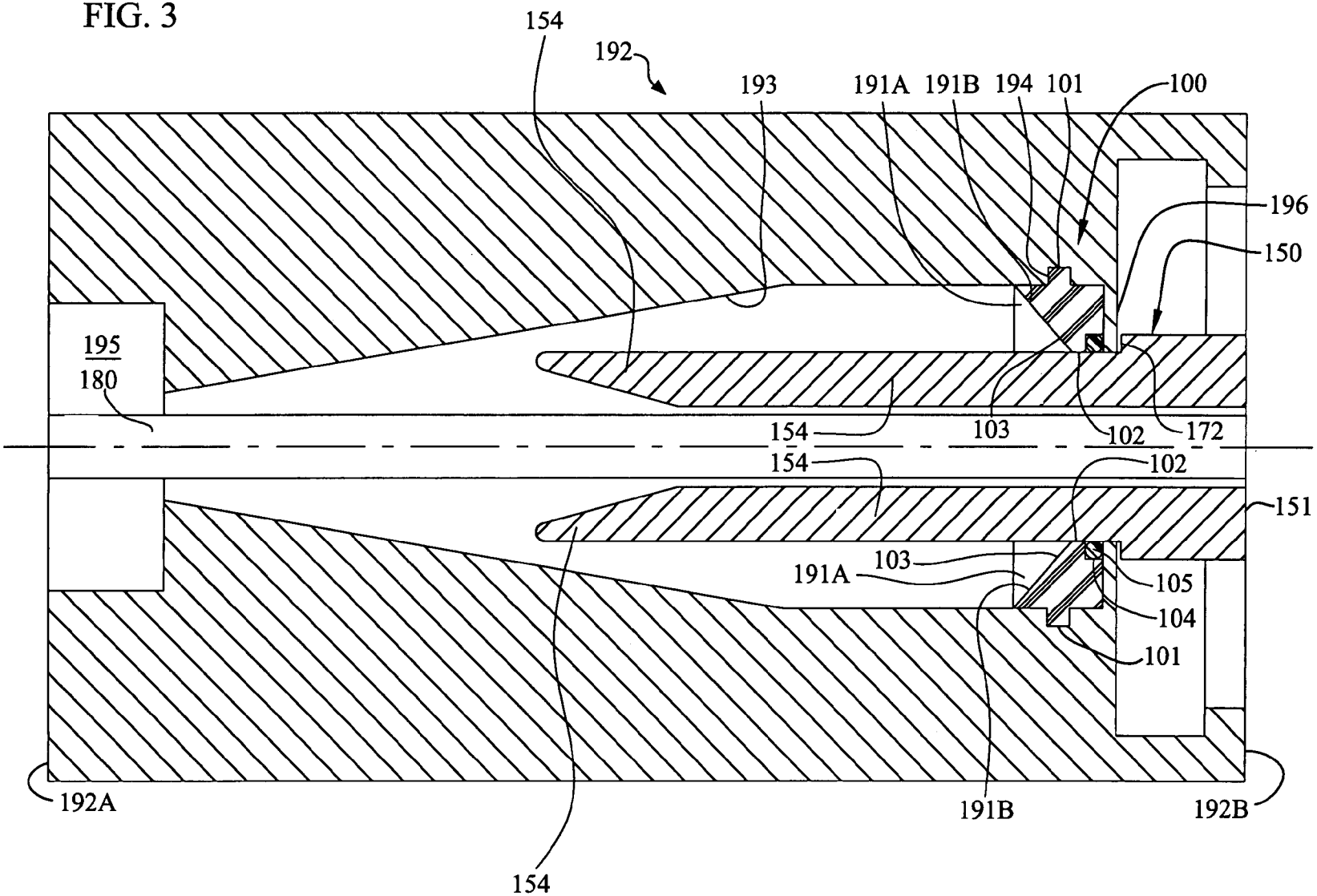
FIG. 3 is a schematic showing of one half of a casting mold defining a casting cavity partially defined by the annular resilient seal of the modified waterproof boot of the invention.

Referring to FIG. 3, in accordance with this invention an annular resilient seal 100 is used to provide a better sealing interface 92 between boot 90 and transition end 154 blocking leakage of water 5 that would otherwise compromise reliable operation of metal electrical connector 150. Electrical connector 150 has an electrically conductive metal housing 151 receiving an electrical cable 180. In all visible details, electrical connector is the same as that described in FIG. 1.

An electrically nonconductive and corrosion resistant protective coating measuring about 0.0010±0.005 inches thick is applied to housing 151 of connector 150 by spraying-on the coating. Like protective coating 70 described with respect to the prior art above, irregular surfaces can be formed in the protective coating on housing 151 due to imperfections of the spraying application technique. Irregular surfaces can also be created on housing 151 as a consequence imperfections in the manufacturing process of connector 150. These irregular surfaces can cause failure of connector 150 on an annular-shaped transition end 154 of connector housing 151 that extends outside of electrical cable 180.

A modified waterproof boot of the invention is molded about transition end 154 of connector housing 151 and electrical cable 180 in a mold 192 to resist sharp bending of cable 180 where it enters connector housing 151. Mold 192 utilizes an annular resilient seal 100 for obtaining better sealing of mold 192 against connector 150, as provided hereinafter.

Annular resilient seal 100 has an essentially triangular cross-sectional configuration and is made from a soft elastomeric composition. Annular resilient seal 100 should be made from a soft elastomeric, heat resistant material. Seal 100 should be sufficiently pliable to seal against mold 192 and sufficiently heat resistant to withstand the curing temperature of the material used to form boot 90. Annular resilient seal 100 is cast in two virtually identical semicircular parts from a liquid casting material. Annular resilient seal 100 has an outwardly extending annular rim 101, an inwardly extending annular rim 102, an annular inclined surface 103 reaching between rims 101 and 102, and an annular groove 104 next to rim 102. Groove 104 is formed between rim 102 and an inward flange 196 of mold 192 to receive an o-ring 105. Annular resilient seal 100 presents an effective barrier for castable material that is being cast in the mold 192 as it pliably accommodates irregular surfaces of protective coating on annular shaped transition ends 154. Annular inclined surface 103 of annular resilient seal 100 acts as a molding surface for watertight boot 90.

Modified waterproof boot 90 is molded by securing two virtually identical halves of a rigid mold 192 together to define a casting cavity 193 to contain transition end 154 of connector housing 151 and cable 180. Casting cavity 193 of mold 192 is coated with a suitable release agent (not shown) to allow removal of boot 90 after it has cured. The first half of mold 192 (depicted in detail, it being understood that the second half of mold 192 is virtually the same) has a cable end 192A positioned about electrical cable 180 and a connector end 192B positioned about transition end 154 of connector 150. Each half of mold 192 has a semicircular groove 194 in connector end 192B to receive and retain annular outer rim 101 of one half of annular resilient seal 100 to create boot casting cavity 193 in mold 192 for molding waterproof boot 90 around transition end 154 and cable 180. Casting cavity 193 is filled with casting material in a liquid form, and having properties as described above, via an open-ended filling cavity 195 in cable end 192A.

Mold 192 is oriented to have filling cavity 195 facing upward so that liquid casting material completely fills boot casting cavity 193 and sets or cures into waterproof boot 90. During casting of boot 90, casting cavity 193 is shaped to place or flow a liquid inclined-end portion 191A of liquid casting material until inclined-end surface 191B bears against all of annular inclined surface 103 of annular resilient seal 100. O-ring 105 in groove 104 resiliently engages transition end 154 of connector 150 to prevent leakage of liquid casting material into other parts of connector 150.

The weight of liquid casting material in mold 192 exerts a downward force on inclined-end portion 191A against annular inclined surface 103 that can slightly deform annular resilient seal 100. Groove 194 in connector end 192B of mold 192 receives rim 101, and retains annular resilient seal 100 in its axial position within mold 192. At least part of the force from inclined-end surface 191B to inclined surface 103 is transferred through annular resilient seal 100 to rim 102. Because the innermost annular surface 102A of rim 102 contacts coating 170 with its irregularities, the soft resilient material of annular resilient seal 100 is slightly resiliently deformed radially inward and pliably accommodates the irregular contours of irregularities to create a positive seal in a sealed annular region along annular sealing surface.

Liquid casting material is typically cured at a temperature dependent on the material used. When liquid casting material of boot 90 cures and sets, it bonds or adheres to outer jacket of electrical cable 180 along the length of cable 180 covered by boot 90 in a watertight sealed relationship. This bonding prevents any leaking of ambient water 5 along the juncture between outer jacket and boot 90. When the curing and setting process is complete, the mold halves 192 are separated and the connector 151, cable 180 and boot 90 are removed. Annular resilient seal 100 is retained with mold 192 where it can be reused.

The components and their arrangements as disclosed herein all contribute to the novel features of this invention. Mold 192 utilized with resilient annular seal 100 of this invention provides a reliable and cost-effective means to assure long term operation of electrical interconnections in the harsh marine environment. Therefore, mold 192 utilized with resilient annular seal 100 as disclosed herein is not to be construed as limiting, but rather, is intended to be demonstrative of this inventive concept.

It will be understood that many additional changes in the details, materials, steps and arrangement of parts, which have been herein described and illustrated in order to explain the nature of the invention, may be made by those skilled in the art within the principle and scope of the invention as expressed in the appended claims.

What is claimed is:

1. A method for making a sealed underwater connector having an annular transition end from an electrical connector and a cable extending therefrom comprising the steps of:

applying a protective coating on said annular transition end, said protective coating having irregularities;

providing mold halves having a boot molding cavity, and an annular resilient seal cavity for molding a waterproof boot around the annular transition end of the electrical connector;

placing the electrical connector and the cable in said mold halves;

providing an annular resilient seal having an annular inclined surface about the electrical connector and the cable when positioned within said annular resilient seal cavity of said mold halves;

sealing the mold halves together with the electrical connector, cable and annular resilient seal positioned in the boot molding cavity and the annular resilient seal cavity;

filling said boot molding cavity of said sealed mold halves with a castable elastomeric material, said castable elastomeric material causing compression of said annular resilient seal against said connector and preventing leakage of castable elastomeric material along said connector; and removing said connector, said cable and said boot molding from said sealed mold halves after said castable elastomeric material has set.

2. The method of claim 1 further comprising the step of curing said castable elastomeric material after said step of filling said boot molding cavity.

3. The method of claim 1 wherein:

said annular resilient seal has a retaining flange formed on an exterior surface thereof;

said annular resilient seal cavity having a seal retaining groove formed therein for retaining the retaining flange; and wherein said step of sealing the mold halves together further comprises positioning said retaining flange of said annular resilient seal in said seal retaining groove formed in the annular resilient seal cavity.

4. The method of claim 3 wherein said annular resilient seal is retained in said seal retaining groove after said step of removing said connector, said cable and said boot molding.

5. The method of claim 1 further comprising the step of coating the surface of said boot molding cavity with a release agent before the step of sealing the mold halves together.

* * * * *